US007526980B2

(12) United States Patent
Bocka et al.

(10) Patent No.: US 7,526,980 B2
(45) Date of Patent: May 5, 2009

(54) UNIVERSAL LOCKING LEVER

(75) Inventors: Ralf Bocka, Musberg (DE); James R. Hartmann, Park Ridge, IL (US); Joseph Z. Wascow, Mundelein, IL (US)

(73) Assignee: Robert Bosch GmbH, Stuttgart (DE)

( * ) Notice: Subject to any disclaimer, the term of this patent is extended or adjusted under 35 U.S.C. 154(b) by 834 days.

(21) Appl. No.: 10/898,875

(22) Filed: Jul. 26, 2004

(65) Prior Publication Data

US 2005/0155232 A1 Jul. 21, 2005

Related U.S. Application Data

(60) Provisional application No. 60/537,269, filed on Jan. 16, 2004.

(51) Int. Cl.
*G05G 1/04* (2006.01)

(52) U.S. Cl. ..... 74/525

(58) Field of Classification Search ..... 74/519, 74/522.5, 523, 525, 493; 30/376, 165, 377, 30/388

See application file for complete search history.

(56) References Cited

U.S. PATENT DOCUMENTS 5,020,407 A 6/1991 Brinlee
5,307,566 A 5/1994 Matzo
5,570,610 A * 11/1996 Cymbal ..... 74/493

FOREIGN PATENT DOCUMENTS

CH 681361 3/1993

* cited by examiner

*Primary Examiner*—Vicky A Johnson
(74) *Attorney, Agent, or Firm*—Greer, Burns & Crain, Ltd.

(57) ABSTRACT

A repositionable operating lever including a lever body having a handle and a generally hollow cylindrical housing, an inner end portion of which has a multi-faced wall configured to engage a multi-faced head portion of an adjusting member, an adjusting member positioned in the cylindrical housing and having a multi-faced head portion engaging the multi-faced wall of the inner end portion, a generally cylindrical end piece configured to fit within an outer end portion of the cylindrical housing, a biasing member having a inner end and a outer end, and wherein the lever body is capable of being moved in the outer direction relative to the adjusting member by manipulation overcoming the biasing force whereby the multi-faced head portion and the multi-faced wall disengage from one another, permitting relative rotation of the lever body and the adjusting member to reposition the lever body on the adjusting member.

19 Claims, 6 Drawing Sheets

UNIVERSAL LOCKING LEVER

This application claims the benefit under 35 U.S.C. §119 of U.S. Provisional Application No. 60/537,269, filed on Jan. 16, 2004.

The present invention generally relates to tools and particularly adjustable locking levers for such tools.

It is known to users of tools that it is often necessary during use to lock tool components in a particular position such as the depth of cut of a plunge router or circular saw or the bevel angle adjustment of a circular saw among many other applications. Through the life of the tool, users often find that the locking components experience wear, which requires a lever to be rotated further to achieve the same locking force. At some point, the lever will interfere with another component external to the locking system, such as a motor housing, a foot of a saber saw or circular saw, among other examples, which prevents the locking lever from being adequately tightened. In prior art systems, the user has been forced to index the lever back to a different position to enable the system to be fully tightened.

Prior art systems in commercially available professional saws have required the removal of a screw or retaining ring to reposition the locking lever. In addition to being inconvenient, there is the prospect of possible loss of the retaining ring or screw. Other tool-less locking and unlocking devices have comprised wing nuts or knobs.

While prior art adjustable lever systems exist which have a lever that can be moved outwardly against the force of a biasing spring from its normal position so that it can be repositioned at a different angle that enables the system to adequately tighten the desired components, these systems generally have required a nut that engages a carriage bolt or the like and another screw that is threaded into the opposite end of a hex head adjusting nut to retain a spring in position that biases the handle into engagement with the hex headed adjusting nut.

It is a goal of the present invention to provide a universal locking lever that has a simpler design that is also easy to assemble in a tool in which the lever may be used.

SUMMARY OF THE INVENTION

A preferred embodiment of the present invention has a universal locking lever system that has a lever in which an adjustment nut is inserted, a carriage bolt or the like which is threaded into the adjusting nut, a spring that has one end bearing against a shoulder in the lever and the opposite end bearing against an end cap, the end cap being configured to snap fit in locking position to the adjusting nut during assembly.

DETAILED DESCRIPTION

Figure 1:
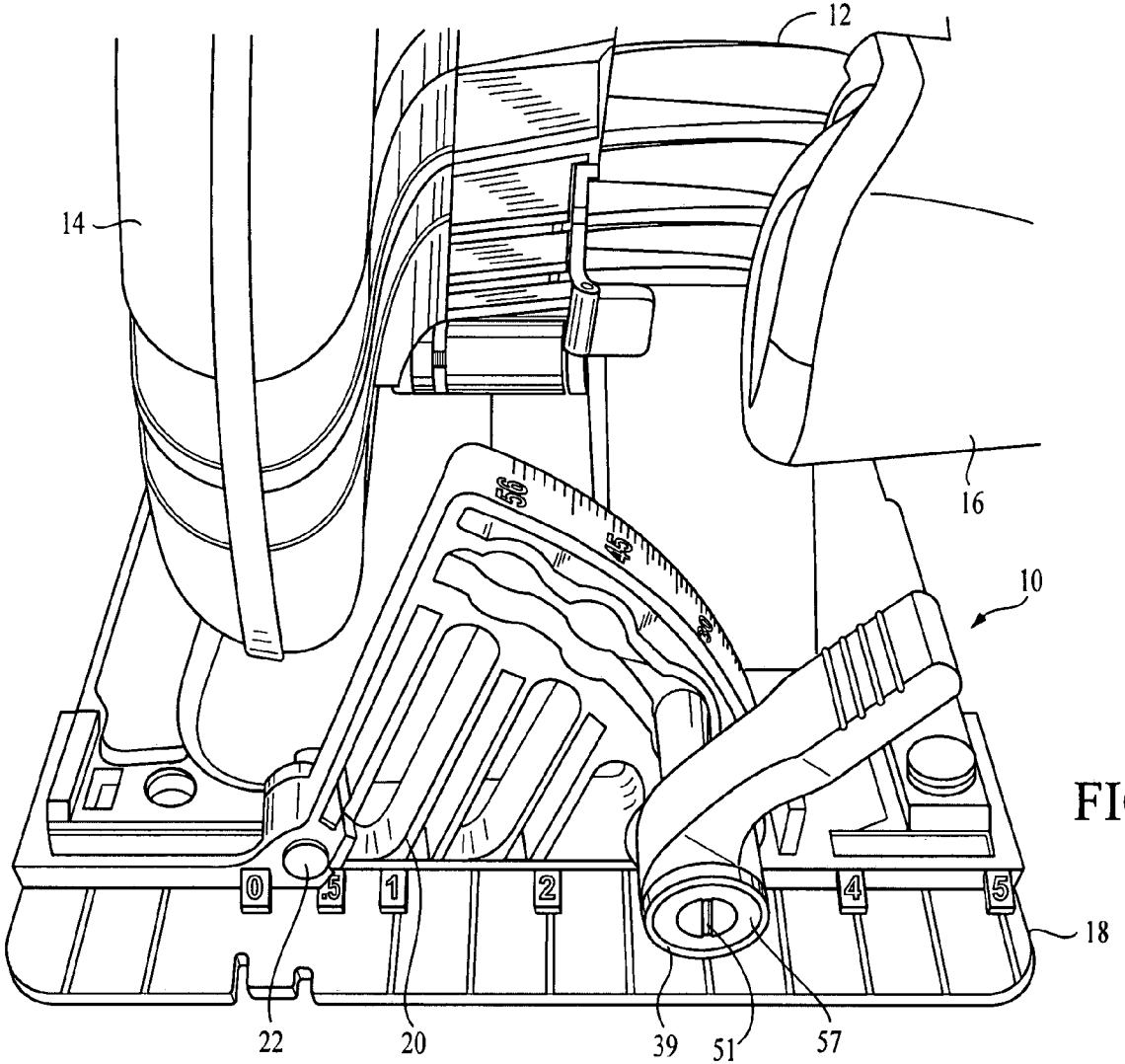
FIG. 1 is a perspective front view of a circular saw having a bevel adjusting mechanism that includes a bevel quadrant with a curved slot in which a carriage bolt of a universal locking lever is attached for locking the saw in a desired bevel angle.

The preferred embodiment of the universal locking lever is shown in the drawings and is useful for locking tool components, such as routers, saber saws, jigsaws and circular saws, as well as in other applications than in the hand tool art. However, the preferred embodiment is particularly suited for use in circular saws such as the circular saw shown in FIG. 1. The saw has a locking lever assembly 10 located at its front for locking a bevel adjustment system in place after it has been set by a user. The circular saw has a motor housing 12, a blade housing 14 in which a cutting blade (not shown) is located, an auxiliary handle 16, a foot 18 on which a bevel quadrant 20 is formed, with the circular saw housing 12, blade housing 14 and blade configured to rotate relative to the foot around a pivot axis defined by a bolt 22. When a lever arm 24 of the locking lever assembly 10 is rotated in a clockwise direction as shown in FIG. 1, it causes an adjusting member 26 to tighten on a threaded fastener 28 such as a carriage bolt or the like that is operatively attached to the motor housing 12 so that counterclockwise movement of the locking lever 10 will loosen the adjusting member 26 relative to the bevel quadrant 20 and permit the bevel angle of the circular saw to be changed.

Figure 2:
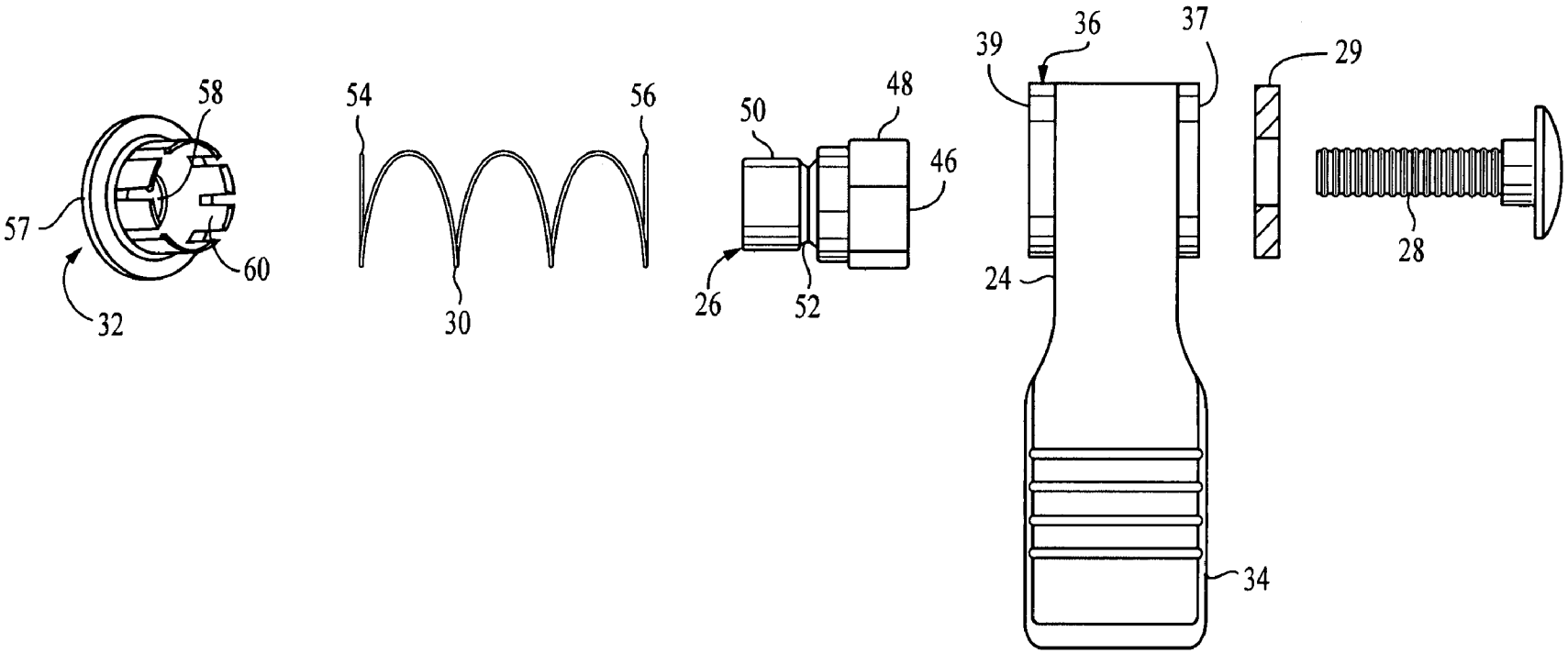
FIG. 2 is an exploded perspective view of the components of the universal locking lever shown in FIG. 1.
Figure 3:
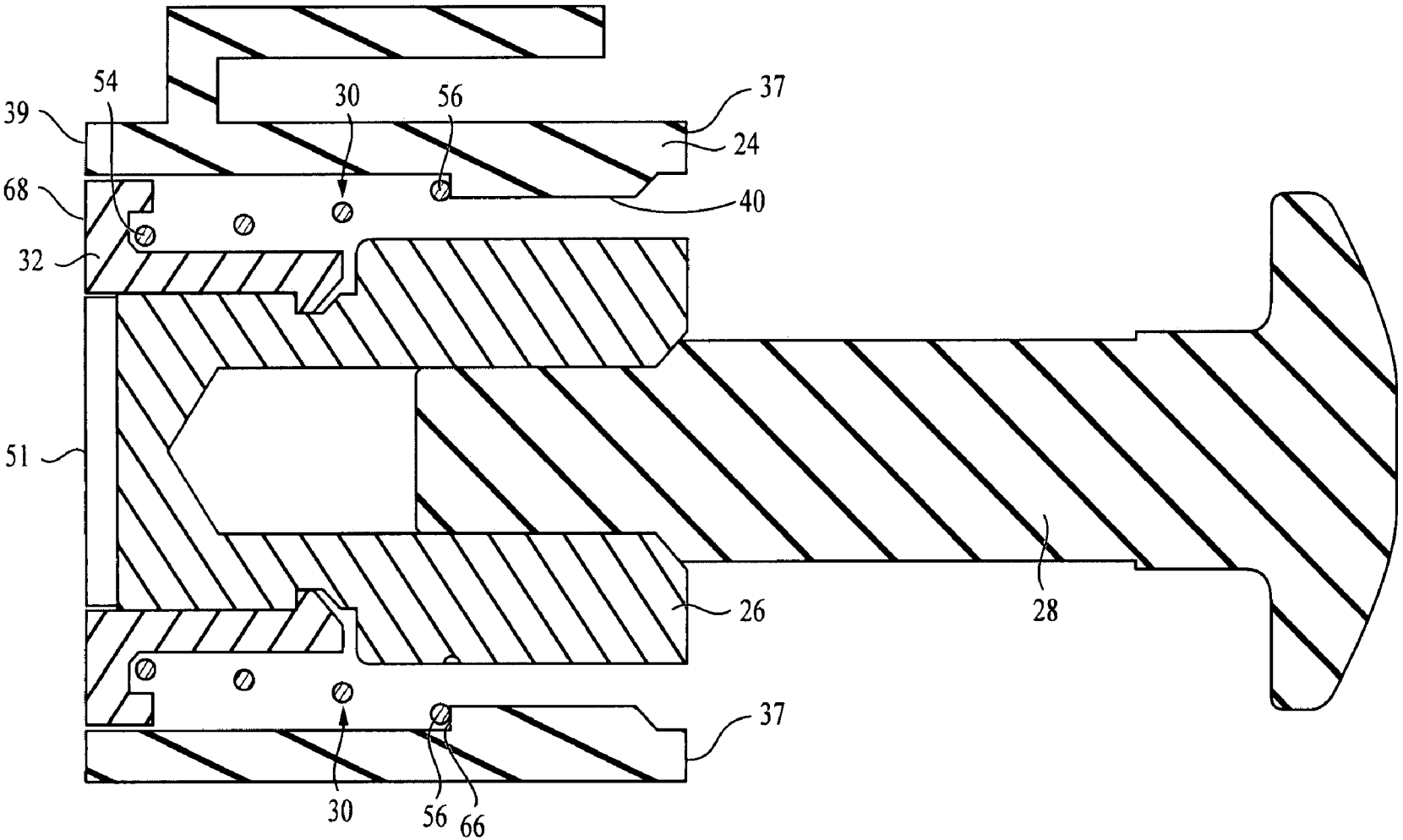
FIG. 3 is a cross-section taken through the center of the universal locking lever shown in FIG. 1 and is taken generally in a vertical plane substantially similar to the section illustrated in FIG. 5.
Figure 4:
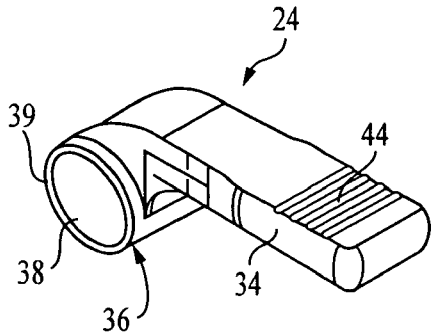
FIG. 4 is a perspective view from a side and rear angle of the locking lever shown in FIG. 2.
Figure 5:
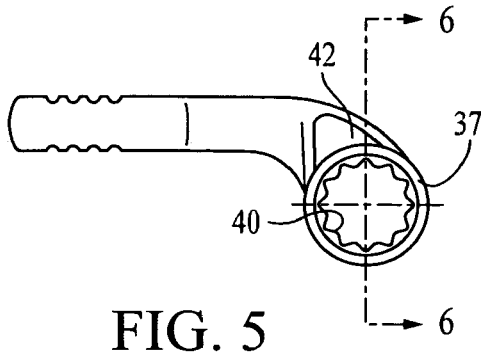
FIG. 5 is a side view of the locking lever shown in FIG. 4.
Figure 6:
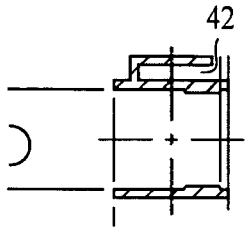
FIG. 6 is a cross-section of the lever taken along the line 6-6 in FIG. 5.

The universal locking lever assembly 10 is shown in the exploded view of FIG. 2 and preferably includes the lever arm 24, the adjusting member 26, the threaded fastener 28 that is illustrated to be a carriage bolt, a washer 29, a biasing member 30 such as a compression spring, and an end cap 32. As is shown in FIGS. 4, 5 and 6, the lever arm 24 has an outer handle portion 34 that extends from a generally cylindrical portion 36 that has a right-hand portion 37 and a relatively smooth inside surface 38 on a left-hand portion 39 thereof. Additionally, a rightward interior portion includes a predetermined key configuration, preferably a double hex configuration 40 as shown in FIG. 5 and in the cross-section of FIG. 3. However, embodiments of the instant invention contemplate that the key configuration may assume a plurality of configurations, such as pentagonal, squared, or spline. As shown in FIG. 6, there is preferably a relief portion 42 that is present to make the lever 24 lighter in weight.

Corrugations 44 or other texturing may be provided to facilitate gripping of the lever arm 24 during use. The adjusting member 26 has an opening in its right end face 46 that preferably includes an internal thread. The adjusting member 26 further includes an end portion configured to engage the preferred double hex configuration 40, preferably a hex head portion 48, and a cylindrically shaped opposite end portion 50 around which an annular groove 52 is disposed. Other embodiments of the invention include an end portion that is shaped to be a plurality of configurations, such as square, pentagonal, spline, or others, such that the end portion is configured to lockingly engage the double hex portion 40 or other corresponding mating configuration. Preferably, an end surface of the opposite end portion 50 includes a slot 51 or other configuration to allow the user to precisely rotate and/or thread the adjusting member 26 to the threaded fastener 28, which extends from a portion of the saw to engage the adjusting member. The biasing member 30 may have a uniform diameter along a length thereof, but in the preferred embodiment, includes a smaller diameter end 54 and the spring increases in size to the larger end portion 56.

Figure 7:
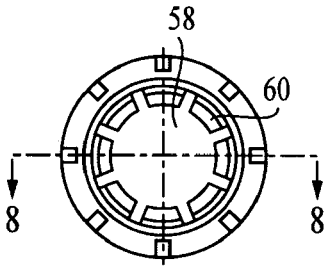
FIG. 7 is an end view of the end cap of the preferred embodiment of the present invention.
Figure 8:
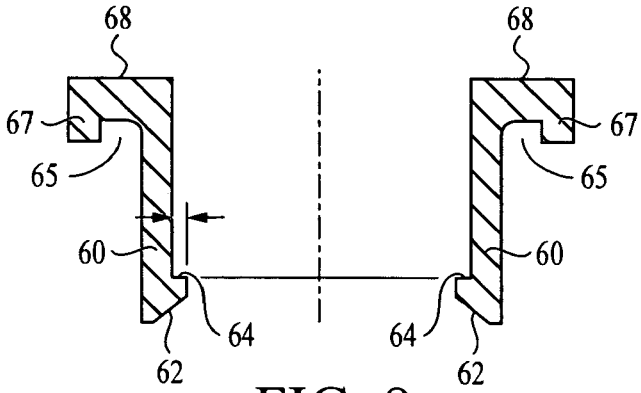
FIG. 8 is a cross-section taken generally along the line 8-8 of FIG. 7.
Figure 9:
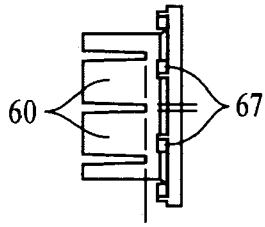
FIG. 9 is a side view of the end cap shown in FIG. 7.

The end cap 32 is shown in detail in FIGS. 7, 8 and 9 and has an annular base 57, interior opening 58 and a plurality of fingers 60, preferably eight, disposed around a circumference of the interior opening, each of which has a beveled end surface 62 and an interior shoulder 64 for engaging the annular groove 52 of the adjusting member 26 when it is forced onto the adjusting nut. There is another annular recess 65 in the opposite end portion that is configured to receive the biasing member 30 when it is installed. The recess 65 is not continuous, but is formed by a plurality of axially oriented tabs 67 that extend downwardly as shown in FIG. 8. In this regard and referring to FIG. 3, the biasing member 30 is shown having its smaller diameter end 54 located in the recess 65 and it increases in diameter to the opposite end 56, where it is restrained by a shoulder 66 located in the cylindrical portion 36 adjacent the hex configuration portion 40.

Thus, as illustrated in FIG. 2, the preferred locking lever assembly 10 is assembled with the threaded fastener 28 threadedly engaging the interior thread of the right end face 46 of the adjusting member 26. The larger end portion 56 of the biasing member 30 engages the shoulder 66 (best shown in FIG. 3), while the smaller diameter end 54 engages the annular recess 65 (best shown in FIG. 8) disposed on the end cap 32 and formed by the plurality of axially oriented tabs 67. When assembled, an outside face 68 of the annular base 57 aligns with and is generally coplanar to a left-hand face 39 of the cylindrical portion 36, with the opposite end portion 50 of the adjusting member 26 matingly engaging the opening 58 of the end cap 32. To maintain locking engagement, the interior shoulder 64 engages the annular groove 52 of the adjusting member 26. Because the biasing member 30 is preferably a compression spring configured to resist compression and the end cap 32 is lockingly engaged to the adjusting member 26, the biasing member urges the hex head portion 48 of the adjusting member 26 into double hex configuration 40 within the cylindrical portion 36 at its rightward interior portion. With the hex head portion 48 engaging the double hex configuration 40, the adjusting member 26 will rotate with the cylindrical portion 36 when rotated by the lever arm 24.

When coupled to the saw, the assembled locking lever 10 may be rotated in either a clockwise or counterclockwise direction to either tighten or loosen the threaded engagement of the threaded fastener 28 and the right end face 46 of the adjusting member 26. Additionally, where slippage and wear creates a situation where the lever arm 24 does not effectively tighten or loosen the engagement because another component external to the locking system interferes, the instant invention provides for quick readjustment of the hex head portion 48 within the double hex configuration 40 of the cylindrical portion 36. More specifically, the user only needs to simply pull out the lever arm 24, which causes the biasing member 30 to compress and the hex head portion 48 to disengage from the double hex configuration 40, at which time the user may reorient and readjust the position of the lever arm 24 to eliminate the interference. Once the user has repositioned the lever arm 24, the user simply releases the lever arm, and the biasing member 30 causes the hex head portion 48 to re-engage the double hex configuration 40 in the readjusted position.

Figure 10:
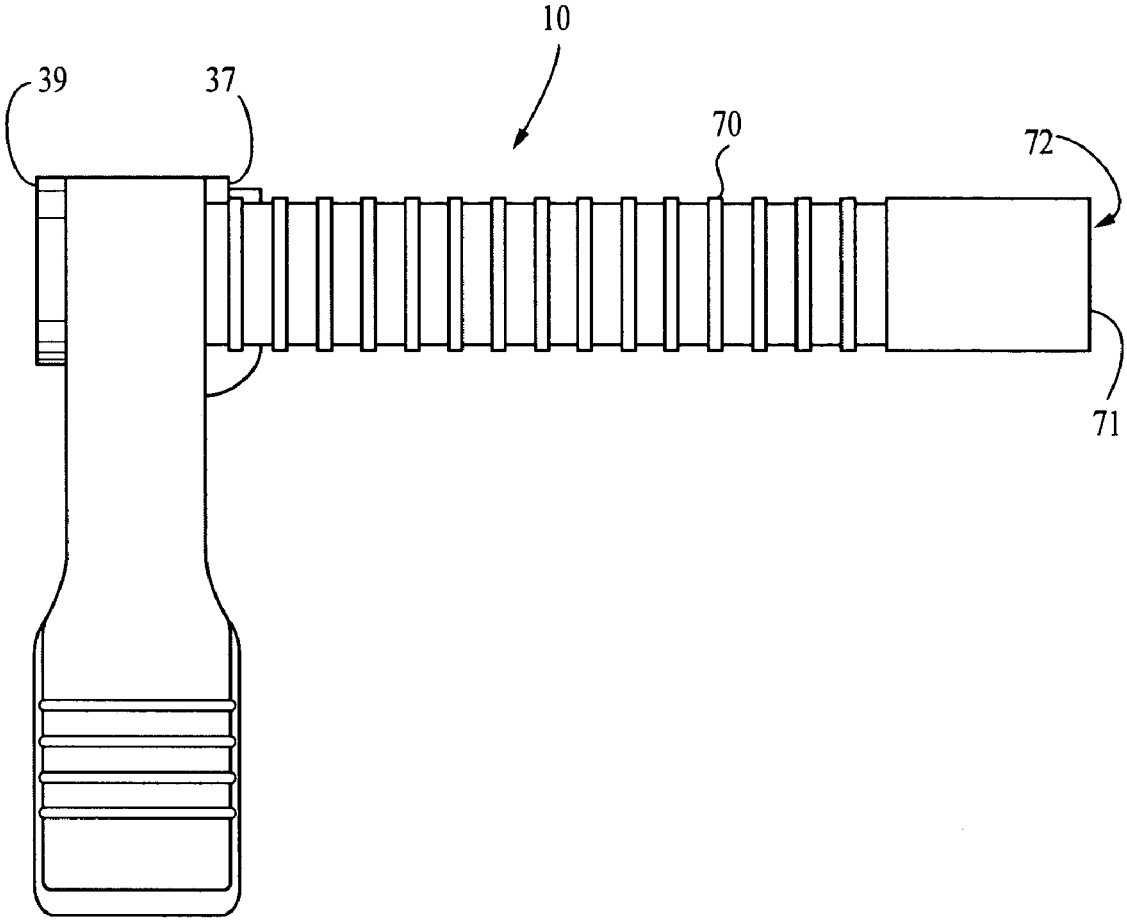
FIG. 10 is a side elevation view of a locking lever according to another embodiment of the invention.
Figure 11:
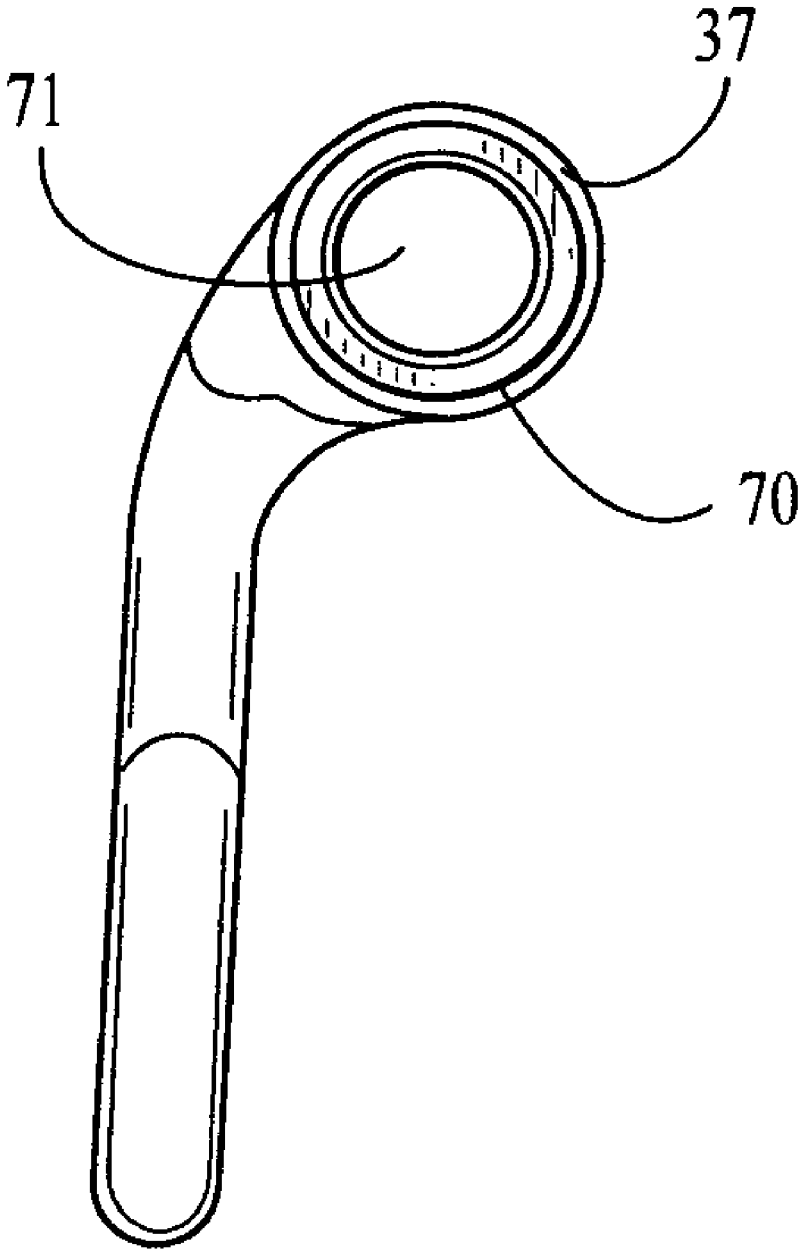
FIG. 11 is a front elevation view of the locking lever of FIG. 10.

One alternative embodiment of the locking lever assembly 10 illustrated in FIG. 10 includes an elongated shaft 70 extending from the left-hand portion 39 and through the cylindrical portion 36, where the elongated shaft is generally cylindrical in shape and includes a central orifice 71 at its right end as shown. A threaded fastener, such as the carriage bolt 28 illustrated in FIG. 2, engages a distal end 72 of the elongated shaft 70 that extends through the cylindrical portion 36 and from the right-hand portion 37 of the cylindrical portion.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

What is claimed is:

1. A repositionable operating lever comprising:

a lever body having a handle and a generally hollow cylindrical housing that includes inner and outer end portions, said inner end portion having a multiple-sided interior wall configured to engage a multiple-sided head portion of a rotatable adjusting member, said outer end portion having a larger inside diameter than said inner end portion to thereby form an annular shoulder;

said rotatable adjusting member threadably engagable with a threaded bolt, said adjusting member being positioned in said cylindrical housing, and having said multiple-sided head portion engaging said multiple-sided wall of said inner end portion of said cylindrical housing when said adjusting member is in its normal operation position, said adjusting member being configured to contact said lever body and prevent relative rotational movement of said adjusting member relative to said lever body when said lever body is in a normal engaged operating position and permit relative rotational movement of said adjusting member relative to said lever body when said lever body is axially moved to disengage said multiple-sided head portion from said multiple-sided wall of said inner end portion;

a generally cylindrical end piece configured to fit within said outer end portion of said cylindrical housing and having a reduced outside diameter inwardly of an end surface to form an annular shoulder, and having a locking configuration for automatically locking said end piece to said adjusting member when pressed onto said adjusting member;

a biasing member having an inner end and an outer end, said biasing member being configured and positioned between said end piece annular shoulder and said cylindrical housing annular shoulder to bias said adjusting member toward its normal operating position;

said lever body being capable of being axially moved to disengage said multiple-sided head portion from said multiple-sided wall of said inner end portion of said adjusting member by manipulation overcoming the biasing force, thereby permitting relative rotation of said lever body and said adjusting member to angularly reposition said lever body on said adjusting member.

2. The lever of claim 1 wherein said handle and said housing are integrally formed with one another.

3. The lever of claim 1 wherein said multiple-sided wall of said inner end portion of said cylindrical housing is configured to be hexagonal in shape for engaging a hexagonal head.

4. The lever of claim 1 wherein an end of said adjusting member opposite said head portion further comprises a slot configured to receive a tool for tightening said adjusting member relative to the threaded bolt.

5. The lever of claim 1 wherein said bead portion of said adjusting member further comprises an at least partially threaded axial orifice therethrough configured to receive a threaded fastener.

6. The lever of claim 1 wherein said adjusting member further comprises an axial extension extending from said head portion.

7. The lever of claim 6 wherein said axial extension comprises a generally cylindrical shaft having an at least partially treaded axial orifice therethrough that is configured to receive a threaded fastener.

8. The lever of claim 1 wherein said locking configuration comprises an inwardly oriented annular flange.

9. The lever of claim 1 wherein said adjusting member further comprises an annular groove configured to receive said annular flange of said end piece.

10. The lever of claim 1 wherein said biasing member comprises a compression spring.

11. The lever of claim 10 wherein a diameter of said inner end is at least slightly larger than a diameter of said outer end.

12. The lever of claim 1 wherein said outer end portion of said housing, said end piece and an end of said adjusting member opposite head portion are generally coplanar when said lever body is in its normal operating position.

13. The locking lever of claim 1 wherein said handle includes texturing for enhanced gripping.

14. A universal locking lever assembly for selectively angularly adjusting and locking components of a tool in various ones of a plurality of predetermined positions, wherein the locking lever assembly engages a threaded bolt, the bolt being operatively connected to the tool and the lever assembly being rotatable to alternatively tighten and loosen the same relative to the bolt to enable the tool to be adjusted relative to a work surface, said lever assembly comprising:

an axially movable rotating member comprising a generally cylindrical housing configured to rotate about a longitudinal axis thereof and having a multiple sided interior configuration for engaging a multiple sided head portion of an adjusting member and prevent relative rotational movement of an adjusting member relative to said rotating body when said rotating body is in a normal engaged operating position and permit relative rotational movement of said adjusting member relative to said rotating member when said rotating member is axially moved to disengage said multiple-sided head portion from said multiple-sided interior configuration;

a lever arm for effecting rotation of said axially movable rotating member;

said rotatable adjusting member for threadably engaging the threaded bolt having an inner end with multiple sided head portion received within and rotating with said axially rotating member;

a cap for engaging an end of the adjusting member at an end opposite the inner end; and a spring for biasing said cap and adjusting member apart from one another;

said rotating member being capable of being axially moved to disengage said multiple-sided head portion from said multiple-sided interrior configuation by manipulation overcoming the biasing force, thereby permitting relative rotation of said rotating member and said adjusting member to angularly reposition said rotating member and lever arm on said adjusting member.

15. The lever of claim 14 wherein said lever arm comprises a generally rectangular extension that is integrally formed with said axially movable rotating member and configured to effect rotation of said axially movable rotating member when rotated in either a clockwise or counterclockwise direction.

16. The lever of claim 14 wherein said adjusting member comprises a generally cylindrical body having a central orifice therethrough, said cylindrical body being configured to be matingly and lockingly received within said cylindrical housing and to rotate with said cylindrical housing.

17. The lever of claim 16 wherein said spring comprises a compression spring.

18. The lever of claim 17 wherein said spring is configured to have a first smaller diameter end that engages said cap and a second larger diameter end that engages said adjusting member.

19. The lever of claim 18 wherein said adjusting member comprises a hex head portion that engages a double hex configuration of said cylindrical housing.

* * * * *